United States Patent [19]

Hoffing

[11] 4,374,493

[45] Feb. 22, 1983

[54] SYSTEM FOR MODEL ROCKET CONSTRUCTION

[76] Inventor: Lawrence B. Hoffing, 14733 McCormick, Van Nuys, Calif. 91411

[21] Appl. No.: 278,818

[22] Filed: Jun. 29, 1981

[51] Int. Cl.[3] ..... F42B 4/08; A63H 33/20

[52] U.S. Cl. ..... 102/348; 46/86 C; 46/74 A

[58] Field of Search ..... 46/74 C, 74 B, 74 A, 46/86 C, 86 B, 86 A, 86 R; 102/348, 347, 351–354, 357, 337

[56] References Cited

U.S. PATENT DOCUMENTS

| | | | |
|---|---|---|---|
| 2,535,309 | 12/1950 | Mari | 102/351 |
| 2,841,084 | 7/1958 | Carlisle | 46/74 A X |
| 3,105,438 | 10/1963 | Aberg | 102/351 X |
| 3,114,317 | 12/1963 | Estes | 102/348 |
| 3,795,194 | 3/1974 | Kendrick | 46/74 A X |
| 3,822,502 | 7/1974 | Belz | 46/86 A X |

*Primary Examiner*—Mickey Yu

*Attorney, Agent, or Firm*—Charmasson, Branscomb & Holz

[57] ABSTRACT

A system and method of construction is described for use in the field of model rocketry. Large sizes of model rockets can be achieved for purpose of visibility and accuracy of simulation by use of a structural framework of disks, ribs, and lightweight covering without exceeding weight limitations of the model.

3 Claims, 4 Drawing Figures

SYSTEM FOR MODEL ROCKET CONSTRUCTION

BACKGROUND OF THE INVENTION

Model rocketry is a growing field for for recreational and hobby purposes and for serious training scientific and educational purposes as well. Many products are being provided for the marketplace and the popular consumer model rockets available closely emulate the appearance of full-scale rockets and other aircraft. A full range of small solid fuel rocket motors together with recovery paraphernalia and control devices is in common use and can launch these model vehicles to significant altitudes.

A particular problem with both recreational and scientific uses of these model rockets is that the rocket motor will quickly propel the small vehicle out of sight of the launcher, diminishing its usefulness for either recreation or education. It would be desireable to increase the size of the rocket model, particularly in diameter, in order to make it more visible at altitudes, to enable modelling of full-size vehicles to the correct proportions and to achieve esthetically pleasing dimensions. Further, compliance with regulations requires weight limitations. Model rocketry is regulated for competitive and safety reasons and rules are promulgated by voluntary educational and hobby associations as well as by state law in some states. Generally these rules conform to the recommendations of the National Fire Protection Association; see for instance Section 3 of NFPA 41-L, Code of Model Rocketry and as adopted, for instance, in the state of California, regulations of the state Fire Marshal adopted pursuant to Title 19 California Administrative Code, Sections 1066 et seq. Rockets of this type are generally limited to 1.1 lbs. or 500 grams by Section 41-L of the Code of Model Rocketry.

A number of devices in the art have received patents but have focused on recovery systems and constructions related thereto as, for instance, Estes, U.S. Pat. No. 3,114,217 and Stine, U.S. Pat. No. 3,646,887. These provide certain constructions but do not address the problems stated above and are size limited by their nature and weight restrictions. The typical tube-type construction shown in those patents is standard in the field and paper or cardboard tubes from one-half inch to three-inch are commonly used. It would be desirable to provide a means of increasing these diameters to the range of six to twelve inches using the same motor and recovery components available for small diameter rockets.

OBJECT AND SUMMARY OF THE INVENTION

The present invention embodies a system and method of construction of model rockets which can accomodate increased diameters and surface area of the body of the rocket by a novel system to expand the size of the rocket with very little added weight. A series of lightweight disks cut from materials such as styrofoam are attached to an inner core consisting of small diameter tubing, and external ribs are provided for support of a lightweight skin.

Thus it is an object of this invention to provide a structurally rigid yet lightweight framework for the body of a model rocket using standard propellant components.

Another object of the invention is to provide a method of constructing a large model rocket that will accomodate a recovery system and will be sufficiently strong and rigid to withstand the forces of the recovery phase of the launching.

Another object of the invention is to provide a system that will not significantly increase the weight of the rocket over that of a common small diameter rocket using the same size motor.

Another object of the invention is to provide an inexpensive method of construction that is easily adaptable to the hobbyist.

Another object is to achieve rear-ejection recovery via parachute to avoid complex construction in the rocket nose.

Another object is to provide a rocket construction that is easily portable by breaking down into sections, yet retaining the ability to rigidly join the sections for launch. A final object of the invention is to provide a model rocket construction of sufficient size that it will be visible to the unaided eye throughout its flight path.

DETAILED DESCRIPTION OF THE PREFERRED EMBODIMENT

Figure 1:
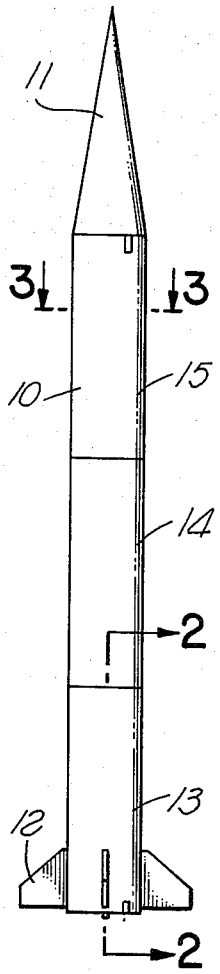
FIG. 1 is a side view of a model rocket using the construction described herein.
Figure 2:
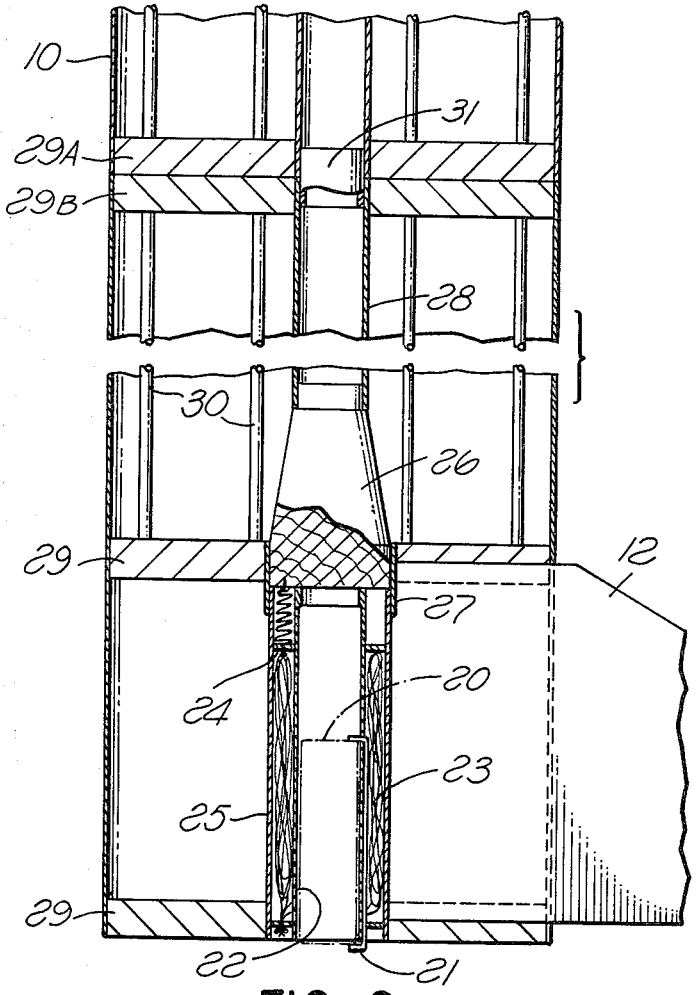
FIG. 2 is a cross section along lines 2—2 of FIG. 1 revealing certain internal elements of the construction.

FIG. 1 illustrates the external appearance of a typical construction using my method. The externally visible components are 10, the skin forming a cylinder and typically composed of lightweight sheet plastic or paper, 11 nose cone joined to the body of the rocket and composed also of lightweight sheet plastic or paper and 12 aerodynamic guide fins attached generally at the base or motor end of the rocket body. The rocket body may be constructed in three sections, designated 13 lower section, 14 center section and 15 upper section. Since the overall size of the rocket is quite large it is desireable to increase the portability by breaking the assembled rocket into sections for transportation to and from the launch site. The description accompanying FIG. 2 below describes that this method of construction is uniquely adaptable to the concept of joinable sections. It will be apparent that having described the rocket as constructed largely of non-rigid sheet materials such as paper or plastic that the rigidity must be reinforced internally. FIG. 2 reveals the reinforcement method.

The cross section of FIG. 2 reveals an inner core based on the standard component rocket motor itself 20, a small cylindrical cartridge held in place by wire clip 21. The rocket motor cartridge is in turn contained in a cardboard tube of light diameter. This tube 22 is available in common sizes and is supplied typically as the body itself of a rocket powered by this size motor. For a smaller rocket the tube itself is rigid enough to provide the basic construction and body of the rocket. For purpose of this invention the tube serves only to provide internal rigidity and to contain the rocket motor. A recovery system is also contained in this general area of the rocket and shown as a folded parachute 23 surrounding the rocket motor tube contained within a cardboard spool 24 and contained in turn within a somewhat larger diameter cardboard tube 25. The operation of this parachute recovery system is described more clearly and in detail below.

It would be possible to continue the lengths of cardboard tubing containing the rocket motor and parachute continuously to the top of the rocket model. However, the weight of such an internal core may be further reduced by reducing the diameter of tubing used above the level of the motor-recovery system level. This is shown in FIG. 2 accomplished by use of a connecting plug 26, here constructed of balsa wood or other lightweight material, joining the larger diameter tube 25 by means of a connecting sleeve 27 and tapering to the smaller diameter at its upper end which joins the main structural tube 28. Structural tube 28 continues to the upper end of the model rocket and can reach quite large dimensions upwards of five or six feet where as the typical hobbyist's small diameter rockets are on the order of three feet. The connecting plug further serves to seal the lower tube as a pressure chamber for parachute ejection sequence, described below.

Figure 3:
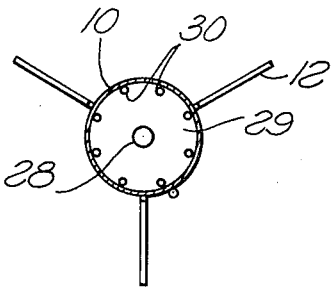
FIG. 3 is a cross section along lines 3—3 of FIG. 1 revealing the diametric construction at that point.

This rigid core construction can be thus expanded upon to increase the diameter of the rocket body as shown in FIG. 2 by a series of lightweight disks 29, of styrofoam, cardboard, balsa wood or the like. The disks are drilled at the center to accomodate the inner structural tubes, glued or fastened in place at intervals along the length, and further support an array of ribs 30 around the outer diameter of the disks. Finally, the ribs support the lightweight skin 10. The disks also provide ample and rigid base for attachment of the fins 12 rather than simple and less rigid attachment only to the skin FIG. 2 also illustrates the method of joining the rocket body sections together for launch, as the body may be constructed in separable sections for portability as described in discussion of FIG. 1. Any two such sections, as for instance 14 and 15 of FIG. 1, may be joined by constructing each section as described with an internal structural tube, a rigid styrofoam disk attached to the tube, ribs attached to the disk and skin covering the ribs. Two such sections are joined together in FIG. 2, the upper section having a styrofoam disk 29A at its lower cylindrical level and the lower section having a styrofoam disk at its upper cylindrical level. When the sections are brought together the disks are adjacent and may be attached together by glue or any suitable fastener and the skin may be reinforced at the joint by a circumferential wrap of adhesive tape. The rigidity of the sectional joint may also be improved by an insert plug contained within the center structural tube of one section which will connect to the center structural tube of the other section. Such a plug is illustrated at 31 on FIG. 2 consisting of a short length of cardboard tubing sized to exactly fit in the internal diameter of the structural tubes. Thus, a number of sections can be joined together quite rigidly and built up to the full size of the model rocket. FIG. 3 further illustrates in diametric cross section the relationship of the skin 10, ribs 30, support disks 29, and internal structural tube 28. The ribs may be embedded slightly in the outer circumference of the disk to provide a smooth surface for attachment of the skin.

The method of joining sections together by fastening the structural disks in adjacent sections can also be adapted to joinder of dissimilar sections. For instance, the top nose cone section illustrated may be joined to the top body section by fastening the top spacer disk of the body section with a similar disk in the base of the nose cone section and attaching as discussed in the preceding paragraph.

Thus, quite large constructions of model rockets are enabled retaining great rigidity and low weight. Clearly, many modifications, details and simulations of actual airborne vehicles can be accomodated using this basic method of model rocket construction, while still retaining the elements and spirit of the construction described, and the system could be adapted to receive any standard internal components such as motors or accessories such as cameras or spotting charges. While the size of the constructions achieved may aerodynamically limit the altitude of the rocket, the flight time determined by engine burn would be basically unchanged and the visible flight of the model rocket made much more appealing and useful.

Figure 4:
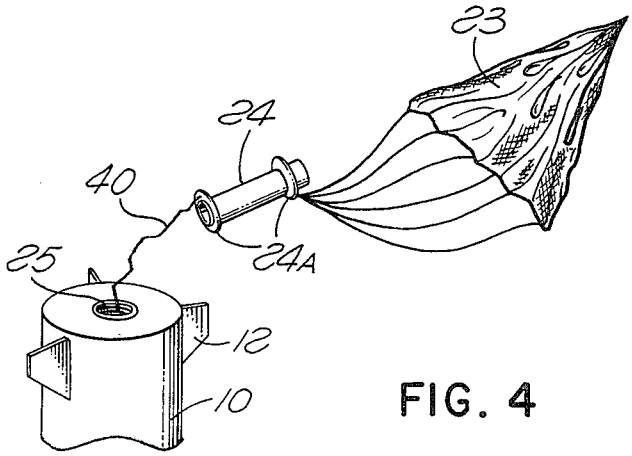
FIG. 4 is a partial perspective view of the tail end of the model rocket construction illustrating actuation of the recovery system.

FIG. 4 further illustrates that the system can accomodate other features such as the recovery system shown. The fact that this recovery system provides a greater amount of hollow internal space enables it to accomodate a parachute recovery system and its actuation method. Where space is more limited such as in typical small diameter tube model rockets, other and less satisfactory recovery systems are employed such as ejection of the parachute at the nose end of the rocket. As previously described a spool 24 is placed around the rocket motor but inside the larger diameter of the body of the rocket. The parachute is attached to the spool and wrapped around the shaft of the spool and between flanges 24A. The spool is further attached to the internal structure by a cord 40. As the rocket motor fuel is consumed after launch and approaches the final burn the last portion of the fuel is vented into the chamber above the parachute spool ejecting the spool from the chamber. The wind stream then activates the parachute and the descent of the rocket is braked.

While I have described the preferred embodiment of the invention, other embodiments may be devised and different uses may be achieved without departing from the spirit and scope of the appended claims.

What is claimed is:

1. A model rocket assembly comprising:

(a) a rocket body having an internal rigid tube containing a solid fuel rocket motor and extending substantially the entire length of the rocket and defining a frame;

(b) substantially circular spacer disks concentric to said tube and spaced along the length of said tube;

(c) a plurality of ribs joined to the outer circumferences of said disks substantially spanning the length of the body of the rocket and defining a frame;

(d) skin formed around the frame of ribs in substantially cylindrical configuration spanning the length of the rocket and defining an enclosed void;

(e) the top portion of said rocket body defining an aerodynamic nose assembly;

(f) aerodynamic fins joined at the base of the rocket body;

(g) said body being defined as a plurality of body sections, each constructed of an internal rigid tube, at least two circular spacer disks coaxial to said tube, a plurality of ribs joined to the outer circumferences of said disks and a skin formed around the frame of ribs in substantially cylindrical configuration such that the sections may be joined together by fastening the circular spacer disk of one section to a disk of next adjacent section forming a continuous cylindrical rocket body.

2. The rocket assembly of claim 1 further including a recovery system comprising a parachute attached to a parachute spool, said spool attached to the rocket body by a cord, the spool having an axial void seating the rocket motor and ejection charge, and the entire recovery system is contained within the internal tube prior to ejection.

3. In a model rocket constructed of a rigid internal tube with a nozzle end containing a solid rocket fuel motor and a framework supporting a cylindrical outer skin, a recovery system comprising:

(a) a hollow spool with an axial hollow slideably fitted into the internal rigid tube containing the solid fuel rocket motor and housing said motor in said hollow;

(b) an upper flange around said spool defining with the upper portion of said rigid tube a gas pressure chamber for ejection of the spool from the nozzle end of the rigid tube together with the spent motor;

(c) a lower flange surrounding said spool defining a space between said upper and lower flanges wherein a fabric parachute attached to said spool is wrapped around the outer circumference of the spool; and (d) a cord attaching the spool to the rocket body such that upon actuation the spool is ejected from the rocket, the parachute is deployed, lowering the rocket to the ground by the attached cord.

* * * * *